United States Patent [19]

Bird

[11] Patent Number: 4,850,479

[45] Date of Patent: Jul. 25, 1989

[54] CONTAINER CARRIER

[76] Inventor: Stanford W. Bird, 745 Three Fountains Cir., Murray, Utah 84107

[21] Appl. No.: 200,955

[22] Filed: Jun. 2, 1988

[51] Int. Cl.[4] ..... B65D 71/00

[52] U.S. Cl. ..... 206/150; 206/151; 294/87.2; 294/159

[58] Field of Search ..... 206/150, 151, 154, 158, 206/169; 294/87.2, 159, 161

[56] References Cited

U.S. PATENT DOCUMENTS

| | | | |
|---|---|---|---|
| 3,084,792 | 4/1963 | Poupitch | 206/150 |
| 3,094,259 | 6/1963 | Diehl | 294/159 |
| 3,268,070 | 8/1966 | Cunningham | 206/150 |
| 3,504,790 | 4/1970 | Owen | 294/87.2 X |
| 3,682,352 | 8/1972 | Doucette | 206/150 X |
| 3,868,140 | 2/1975 | Gordon | 294/87.2 |
| 4,196,807 | 4/1980 | Brom | 294/87.2 X |
| 4,782,955 | 11/1988 | Weaver et al. | 206/150 X |
| 4,793,647 | 12/1988 | Marvin | 206/150 X |

*Primary Examiner*—John Rivell

*Attorney, Agent, or Firm*—B. Deon Criddle

[57] ABSTRACT

This invention relates to a container carrier formed from a flat sheet of durable, flexible material. In a preferred embodiment, the container carrier includes four sets of concentric drinking cup carrying holes, each set of holes comprising a smaller hole dimensioned to fit around the circumference of the lower portion of a conventional drinking cup, and the larger hole dimensioned to fit around the circumference of the upper portion of said cup. The sets of holes are positioned symmetrically about transverse and longitudinal axes of the device. Outboard of the two sets of holes that are symmetric about the longitudinal axis are formed two handle members that join together to form a handle for carrying the device and drinking cups carried by the device.

14 Claims, 1 Drawing Sheet

CONTAINER CARRIER

BACKGROUND OF THE INVENTION

1. Field of the Invention

This invention relates to carriers for transporting containers, and particularly relates to carriers for transporting filled drinking cups.

2. Prior Art

There are numerous carriers currently available for supporting and transporting drinking cups. Some of the carriers comprise a tray having holes sized to fit the bottom of a particular size cup. Other configurations include a bottom upon which the cup rests and a raised platform having holes through which the cup is inserted in a manner to rest on the bottom. These known containers provide only limited lateral support for cups being carried or otherwise transported, for example in an automobile, or while the cups are sitting on a seat or on the floor.

Other carrier configurations include some type of frame that engages the periphery of the cup and/or the cup lip, thereby suspending the cup from the lip. These particular types of configurations may also have a tray-like flat bottom.

A principal problem inherent in existing container carriers is that they do not support filled cups adequately, and are not adaptable to support different numbers of cups. If such carriers are filled with the maximum number of cups for which they are designed, they may be relatively stable. However, if fewer than the maximum number of cups for the particular design are placed in the container carrier for transporting, such carrier stability is frequently lost. These particular types of tray/frame devices are also frequently difficult to carry, requiring both hands of the user, and often still twisting or bending so as to tip or otherwise spill one or more of the filled cups.

Container carriers are provided with takeout food and drink orders in fast-food type restaurants, movie theaters, etc. For this reason, such carriers must be easy to use and inexpensive to manufacture. Consequently, carriers are often made of a thin cardboard material, and therefore are able to accommodate only a very limited weight load.

Finally, many container carriers are made in several sections and require an attendant to assemble them prior to use. Additionally, the different sections of the carriers occupy valuable space that may be better utilized for other purposes. Therefore, bulky or otherwise multiple-section container carriers are difficult to store at a drink counter where they are most needed.

OBJECTS OF THE INVENTION

A principal object of the present invention is to provide an effective carrier for containers such as filled soft drink cups.

Another object of the present invention is to provide a container carrier that is made in a unitary piece.

A further object is to provide a container carrier that incorporates the high strength necessary to support even large or kingsize filled drinking cups.

Yet another object of the present invention is to provide a container carrier that interlocks a plurality of drinking cups to provide increased lateral stability for the contained cups when the cups, held by the carrier, are placed on a support surface.

Another object of the present invention is to provide a container carrier wherein the lateral stability of the cups does not depend upon the number of cups carried therein.

A still further object of the present invention is to provide a container carrier which includes a carrying handle as an integral part thereof.

A still further object of the present invention is to provide a container carrier that is readily mass produced from inexpensive sheet plastic by a single manufacturing step.

Yet another object of the present invention is to provide a container carrier wherein the containers are supported at both sides of a central portion thereof, close to the center of gravity of a filled drinking cup, rather than either the top or bottom portion thereof, wherein the filled containers would be more likely to tip over.

Other objects of the present invention are to provide a container carrier which occupies very little shelf space, and is easy to store and use.

SUMMARY OF THE INVENTION

These and other objects and advantages are realized by a container carrier made from a flat sheet of strong, flexible material, such as plastic, having an arrangement of essentially concentric holes or openings formed therein in a manner to support a drinking cup or container both above and below a central portion, generally about the periphery of the cup. In a preferred embodiment, the container carrier incorporates four sets of concentric holes or openings located in the shape of a diamond pattern, i.e., the center points of each of the sets of concentric openings are located at the four corners or points of a diamond shape.

Within each set of concentric holes are a first or smaller hole and a second or larger hole, concentric with the first hole. The smaller holes are adapted to receive and support therein a lower portion of a drinking cup, and the larger concentric holes are adapted to receive and support therein essentially an upper portion of the drinking cup. In this manner, the container carrier simultaneously supports both the upper and lower portions of a drinking cup while maintaining the cup in vertical orientation to prevent tipping over and spillage of the cup.

The container carrier includes two handle portions, each handle portion being located slightly outboard of a respective set of concentric holes that are the closest together, i.e., the handle portions are symmetric about a longitudinal axis passing through the longitudinal points of the diamond shape. A tab slot is formed in one of these handle portions and receives therein a tab formed with the other handle portion in a manner that the two opposing handle members may be curled inwardly together and interlocked to form a carrying handle.

Other objects and features of the invention will become apparent from the following detailed description and drawing disclosing what is presently contemplated as being the best mode of the invention.

IN THE DRAWINGS

DETAILED DESCRIPTION OF THE INVENTION

Figure 1:
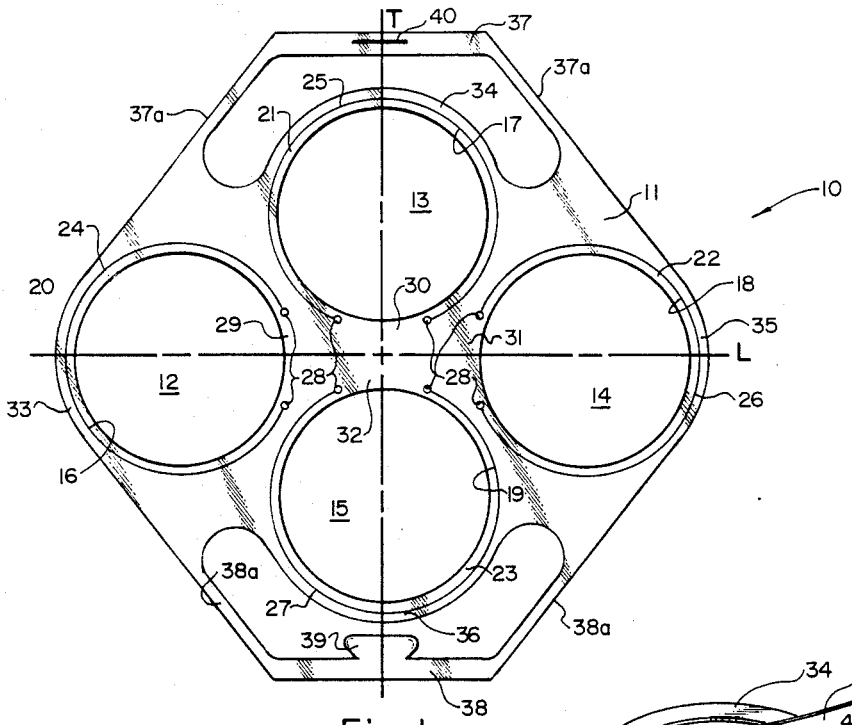
FIG. 1 is a top plan view of the container carrier invention, showing the carrier in its unassembled form.

Turning now to the drawings, and initially to FIG. 1, the container carrier of the present invention is shown, generally illustrated by the numeral 10. In a preferred embodiment, the carrier 10 is constructed of a sheet of flat, durable, flexible material 11, such as plastic. Although the container 10 appears to be formed of an essentially square sheet, for purposes of convention and explanation, a longitudinal axis L and a transverse axis T are designated. Also for purposes of convention, although the container carrier is adapted to carry a number of various shaped containers, it is designed primarily to carry tapered cylindrical drinking cups; therefore throughout this description, the container will be referred to as a cup.

Referring again to FIG. 1, the preferred embodiment of the container carrier 10 includes four first or smaller holes 12, 13, 14, 15 for receiving therein the lower portions of drinking cups (not shown in FIG. 1). As shown, the holes 12–15 are oriented in a diamond pattern, with holes 12 and 14 being in the longitudinal axis L, and holes 13 and 15 being in the transverse axis T. As will be described in greater detail hereinbelow, holes 12–15 are sized to receive the lower portions of standard drinking cups.

The container carrier 10 also includes four second or larger holes 16, 17, 18, 19, oriented concentrically about first holes 12, 13, 14, 15, respectively. The second holes 16–19 are formed by shear punching small annular support bands 20, 21, 22, 23 about first holes 12, 13, 14, 15, respectively. The annular support bands 20–23 forming the second holes 16–19 are formed by shear punching the plastic material 11 at shear lines 24, 25, 26, 27, respectively. The shear lines 24–27 do not form closed circles, but rather terminate in punched holes 28, formed to prevent the shear lines from ripping or tearing. In this manner, the annular support bands 20–23 remain integrally formed with the central portion of the container carrier at respective attachment sections 29, 30, 31, 32, and are prevented from tearing or ripping from the carrier under the weight of filled drinking cups.

The shear lines 24–27, which form the annular support bands 20–23, also cooperate with an outer portion of the plastic material 11 forming the carrier, to define a set of larger support bands 33, 34, 35, 36, respectively. These larger support bands 33–36 are at least partially annular, being formed by respective essentially circular shear lines 24–27, and are essentially concentric about respective smaller annular support bands 20–23. As shown, the larger support bands 33–36 are also integrally formed with both the central portion and the outer portion of the container carrier.

The container carrier 10 includes handle portions 37 and 38, located outboard of the holes 13 and 15, respectively. These handle portions are integrally formed with respective outer portions of the plastic material of the carrier, to be essentially symmetric about the longitudinal axis L. The handle portions are formed with the outer portions by respective connecting pieces **37*a* and 38*a*. Handle portion 38 is formed with an inwardly disposed tab 39, sized to fit into a tab slot 40, formed in the handle portion 37**, whereby the two handle portions may be locked together in a conventional manner.

Figure 2:
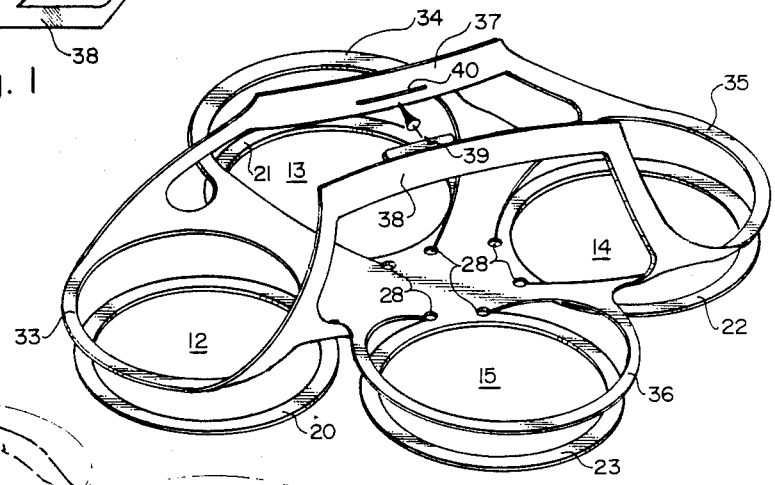
FIG. 2 is a perspective view illustrating how the carrier handle portions are brought together to be attached together to form the carrier handle.
Figure 3:
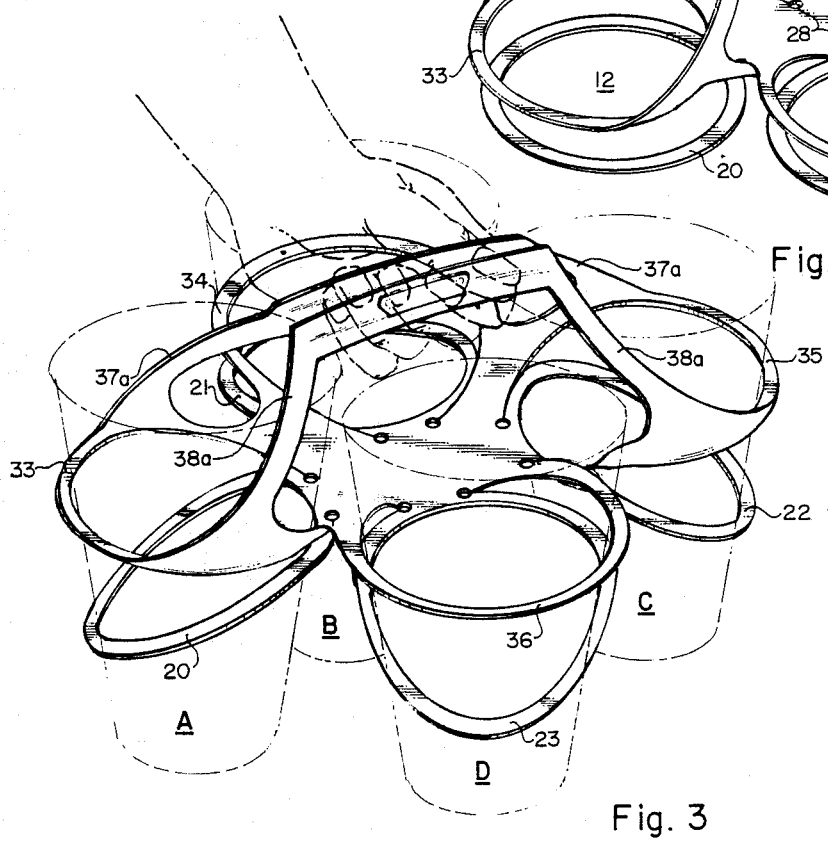
FIG. 3 is a perspective view of the assembled container carrier showing four drinking cups in dotted lines in functional carried position within the container, and also showing, in dotted lines, a hand gripped around the container carrier handle.

FIG. 2 illustrates how the container carrier 10 is intended to be curled inwardly at the handle portions 37, 38 about the longitudinal axis L in a manner to attach to two handle portions together. It should be noted that in the position shown in FIG. 2, and when the container carrier is in functional position as shown in FIG. 3, the smaller annular support bands 20–23 are designed to remain essentially flat in the original plane of the uncurled container carrier material. As will be explained in greater detail below, this feature enables the annular pieces 20–23 to provide true lateral support to a drinking cup carried within the container carrier.

Referring now to FIG. 3, the container carrier of the present invention is shown in functional position, holding four conventional drinking cups, shown in phantom at A, B, C, and D, in vertical, essentially spill-proof orientation. In this functional carrying position shown, the smaller annular support bands 20–23 remain essentially planar in a generally horizontal plane, normal to the vertical axes of the drinking cups, and are always spaces apart from the larger support bands 33–36. So oriented, the larger support bands 33–36 function to (1) provide essentially uniform lateral support about the respective upper portions of the drinking cups; and (2) provide an essentially uniform vertical lifting force about upper portions of the drinking cups for carrying the caps. Simultaneously therewith, the smaller annular support bands 20–23 function to (1) provide essentially uniform lateral support about the lower portions of the drinking cups, and (2) because of their spaced relationship to the larger support bands, maintain the respective drinking cups in essentially vertical alignment, normal to the essentially horizontal plane of the smaller annular support bands. By being held in such orientation, the drinking cups A–D are retained in essentially spill-proof vertical position while being carried about within the container carrier. Additionally, it should be noted that the container carrier enables the drinking cups A–D to be set upon an essentially flat horizontal surface, the container carrier remaining functionally attached to each of the drinking cups and retaining the drinking cups in essentially vertical orientation so as to prevent tipping and/or spillage of any of the drinking cups held therein.

Again, with reference to FIG. 3, the aforementioned uniform lateral support about the individual drinking cups will now be explained. As the handle is pulled vertically, the two end larger support bands 33, 35 are tensioned by the respective handle connecting pieces **37*a*, 38*a* to create the lateral supporting force essentially around the upper circumference of the drinking cups A and C. Simultaneously therewith, the handle connecting pieces 37*a*, 38*a* tension the second set of larger support bands 34, 36 about the transversely oriented drinking cups B and D to provide the the lateral support essentially around an upper circumference of the cups B and D. It should be noted that the larger support bands are tensioned individually by the handle connecting pieces, and independently of one another. Thus, when the handle is pulled upwardly, each of the larger support bands 33–36 independently frictionally engages a respective drinking cup A–D, and grasps the outer circumferential surface of such cup. With each of the drinking cups being primarily supported by these larger support bands 33–36, the smaller annular support bands 20–23, being spaced apart from the larger support bands, function to maintain the drinking cups A–D in essentially vertical upright position by "centering" or "aligning" each of the cups within the geometric center of the respective smaller and larger support bands. When the handle portions 37 and 38 are interlocked, the handle portions 37***a* and 38*a* extend diagonally across the rim of the cups placed in holes 12 and 14, or either of them, so that the container 10 will not drop with respect to the cup or cups.

An essential feature of the present invention is the geometry of the cooperating smaller and larger support bands, and specifically the way they cooperate when the container carrier is being used as intended. As can be seen from FIG. 3, the carrier provides for vertical support of the drinking cups A–D because of the relationship of the sizes of the particular holes to sizes of the drinking cups, and because of the frictional engagement of the larger support bands 33–36 against the drinking cups when the cups are being carried within the carrier. These larger support bands, therefore, provide both the vertical, or carrying, force, and the lateral support for the drinking cups. this lateral support about the upper portions of the drinking cups, in combination with "aligning" lateral support provided by the smaller annular support bands, constantly maintains the cups in vertical orientation. Therefore, if the container carrier is placed on a car seat, for example, the carrier will maintain the cups in vertical upright position and prevent the cups from tipping or otherwise spilling their contents.

It is a very important feature of the present invention that the container carrier is capable of carrying fewer than a full complement of drinking cups in a manner identical to the manner in which the container carries a full complement of drinking cups (i.e., four). This particular feature is accomplished by the provision of the combination of the smaller annular support bands 20–23 and the larger support bands 33–36 individually cooperating to provide uniform lateral support about the lower portion of the drinking cups, concurrently with uniform lateral support about the upper portion of the drinking cups. As previously explained, the handle portions 37, 38, through the handle connecting pieces 37*a*, 38*a*, tension the larger support bands 33–36 and the smaller annular support bands 20–23 each individually and independently of the other bands. Therefore the presence or absence of a cup in position in any of the sets of holes has no effect upon the tensioning of the support bands around a cup in position in any other of the sets of holes.

OPERATION

Although use of the container carrier of the present invention should be readily apparent from the foregoing DETAILED DESCRIPTION, the inventor has determined that the better procedure to follow in "loading" the carrier is to initially place the carrier, in its planar configuration shown in FIG. 1, on a flat, horizontal support surface, as on a counter top. Next, the user places any number of filled drinking cups within the smaller holes 12–13. Here it should be pointed out that if two cups are to be carried, they should be placed in holes 13 and 15, rather than holes 12 and 14, in order to increase the stability of the carrier. Likewise, if three cups are to be carried, holes 13 and 15 should be used first, the third cup being placed in either hole 12 or 14.

With the filled drinking cups so placed in the holes, the user then curls the handle portions upwardly toward each other and attaches the handle portions together using the tab and slot mechanism. The user then grasps the handle and carriers the cups about, as intended. The inventor has found this sequence to be preferable to trying to insert filled drinking cups into the carrier with handle portions attached.

It is not necessary to separate the handle portions in order to remove the drinking cups from the "end" holes 12, 14; the cups may simply be removed with the carrier in functional position, as shown in FIG. 3. To remove drinking cups from the "side" holes 13, 15, it may be somewhat easier to separate the handle portions first, although some users may find it equally simple to remove the "side" cups with the handle intact.

Although a preferred form of my invention has been herein disclosed, it is to be understood that the present disclosure is made by way of example, and that variations are possible without departing from the scope of the hereinafter claimed subject matter, which subject matter I regard as my invention. For example, the preferred embodiment has been illustrated and described as accommodating a single size drinking cup in each receiving hole. It should be understood that the container carrier of my invention may be constructed having different combination of different size holes, in order to accommodate a number of different size drinking cups.

I claim:

1. A container carrier comprising a sheet of flat, durable, flexible material having a central portion having at least one first opening therein dimensioned to supportably receive therein a lower portion of a tapered container;

an outer portion, peripheral to and integral with said central portion, said outer portion defining at least one second opening formed to be essentially concentric with said first opening, said second opening being dimensioned to supportably receive therein an upper portion of said tapered container; and a pair of diagonally opposed handle portions integrally formed with said outer portion, said handle portions being removably attachable together to define a handle when said sheet of material is curled inwardly at said handle portions.

2. A container carrier as recited in claim 1, wherein said first opening and said second opening are essentially circular.

3. A container carrier as recited in claim 1, wherein said sheet of flat, durable, flexible material is a plastic material.

4. A container carrier as recited in claim 1, wherein said central portion further includes a plurality of first openings, and wherein said outer portion further includes a plurality of second openings, each of said second openings being formed to be essentially concentric with a respective one of said first openings.

5. A container carrier as recited in claim 4, wherein said first openings and said second openings are essentially circular.

6. A container carrier as recited in claim 4, wherein said first openings and said second openings are in pairs, each of said pairs being oriented essentially symmetrically about the geometric center of said sheet of material.

7. A container carrier as recited in claim 6, wherein a first pair of said first openings and a first pair of said second openings are oriental adjacent said pair of handle portions.

8. A container carrier comprising a sheet of flat, durable, flexible material having a central portion having a plurality of pairs of small openings therein, each of said small openings being dimensioned to supportably receive therein a comparably sized portion of a tapered container;

an outer portion, peripheral to and integral with said central portion, said outer portion defining a plurality of pairs of large openings, each of said large openings being essentially concentric with a respective one of said small openings, and each of said large openings being dimensioned to supportably receive therein a comparably sized portion of said tapered container; and a pair of diagonally opposed handle portions integrally formed with said outer portions, said handle portions being removably attachable together to define a handle when said sheet of material is curled inwardly at said handle portions.

9. A container carrier as recited in claim 8, wherein said sheet of flat, durable, flexible material is a plastic material.

10. A container carrier as recited in claim 8, wherein said small openings and said large openings are essentially circular.

11. A container carrier as recited in claim 10, wherein said small openings and said large openings are in pairs, each of said pairs being oriented essentially symmetrically about the geometric center of said sheet of material.

12. A container carrier as recited in claim 11, wherein a first pair of said small openings and a first pair of said large openings are oriented adjacent said pair of handle portions.

13. A container carrier formed from a sheet of flat, durable, flexible material, said carrier comprising:

a central portion having two pairs of small, essentially circular openings therein, each of said small openings being dimensioned to supportably receive therein a comparably sized portion of a tapered container;

an outer portion, peripheral to and integral with said central portion, said outer portion defining two pairs of large essentially circular openings, each of said large openings being essentially concentric with a respective one of said small openings, and each of said large openings being dimensioned to supportably receive therein a comparably sized portion of said tapered container; and a pair of diagonally opposed handle portions integrally formed with said central portion and with said outer portion, each of said handle portions being oriented adjacent a respective one of said small openings and said essentially concentric large openings, and said handle portions being removably attachable together to define a handle when said sheet of material is curled inwardly at said handle portions.

14. A container carrier as recited in claim 8, wherein said sheet of flat, durable, flexible material is a plastic material.

* * * * *